US005629760A

United States Patent [19]

Hayashi et al.

[11] Patent Number: 5,629,760

[45] Date of Patent: May 13, 1997

[54] IMAGE FORMING APPARATUS COMPRISING MEDIUM ATTRACTION MEANS

[75] Inventors: Yukio Hayashi; Norio Hokari; Shuji Iseki; Jyunichiro Sameshima; Mikio Kobayashi; Ryoichi Tsuruoka, all of Ebina, Japan

[73] Assignee: Fuji Xerox Co., Ltd., Tokyo, Japan

[21] Appl. No.: 630,480

[22] Filed: Apr. 10, 1996

[30] Foreign Application Priority Data

Apr. 15, 1996 [JP] Japan ..... 7-114020

[51] Int. Cl.[6] ..... G03G 15/14; G03G 15/01

[52] U.S. Cl. ..... 399/312; 399/66; 399/299; 399/394

[58] Field of Search ..... 355/309, 208, 355/271, 273, 326 R, 327

[56] References Cited

U.S. PATENT DOCUMENTS

| | | | |
|---|---|---|---|
| 3,642,362 | 2/1972 | Mueller | 355/309 |
| 5,019,871 | 5/1991 | Takeda et al. | 355/309 |
| 5,150,165 | 9/1992 | Asai | 355/271 X |
| 5,291,245 | 3/1994 | Charmitski et al. | 355/208 |
| 5,444,523 | 8/1995 | Sameshima et al. | 355/309 |
| 5,541,708 | 7/1996 | Tsuruoka | 355/208 |
| 5,557,383 | 9/1996 | Hasegawa et al. | 355/271 |

FOREIGN PATENT DOCUMENTS

| | | | |
|---|---|---|---|
| 0377315 | 7/1990 | European Pat. Off. | 355/326 |
| 62-51530 | 3/1987 | Japan . | |

*Primary Examiner*—Arthur T. Grimley
*Assistant Examiner*—Sophia S. Chen
*Attorney, Agent, or Firm*—Oliff & Berridge

[57] ABSTRACT

An image forming apparatus includes: medium transporting belt that carried an image recording medium on its surface, and is driven so that the surface is circulatively turned; a plural number of toner image forming drums facing the transporting belt, each including an image bearing surface having an electrostatic latent image formed thereon, a developing unit for developing the electrostatic latent image into a toner image, and an image transferring unit for transferring the toner image on the transporting belt or an image recording medium held on the transporting belt; medium supplying trays and path for successively supplying image recording media to the transporting belt; a medium attracting electrode facing the transporting belt; a counter electrode opposing to the medium attracting electrode with respect to the medium attracting electrode; an electric field formed between the medium attracting and counter electrodes to cause the transporting belt to attract the image recording medium to the transporting belt; and control unit that controls voltage applied from a power source between the medium attracting and counter electrodes so that electric field developed therebetween when the image recording medium is not interposed therebetween is weaker than an electric field developed therebetween when the image recording medium is interposed therebetween, and has such a direction as to cause the transporting belt to attract the toner to the transporting belt.

5 Claims, 8 Drawing Sheets

IMAGE FORMING APPARATUS COMPRISING MEDIUM ATTRACTION MEANS

BACKGROUND OF THE INVENTION

1. Field of the Invention

The present invention relates to an image forming apparatus which includes a medium transporting means which transports an image recording medium while holding the medium thereon, and forms a multi-color image in such a way that color toner images are formed in a plural number of toner image forming units and successively transferred onto an image recording medium in a superposing manner.

2. Discussion of the Prior Art

An electrophotographic image forming apparatus of the type in which toner images of different colors are successively transferred onto an image recording medium in a superposing manner, to thereby form a multi-color image, is well known. The image forming apparatus includes a medium transporting means which transports an image recording medium while sucking the medium, and a plural number of photoreceptors disposed along the medium transporting means. Further, a charger, a scan optical system, a developing unit, and the like are disposed around each of the photoreceptors. An image recording medium is fed onto the medium transporting means and attractively held by the same. The image recording medium, carried by the medium transporting means, moves forward successively by the photoreceptors. Through the movement of the image recording medium, toner images are transferred onto the image recording medium in a superposing manner, from the photoreceptors.

The following means to cause the medium transporting means to attract the image recording medium to the medium transporting means per se is widely used for the image forming apparatus of this type.

The medium transporting means taking the form of an endless belt or a drum is known. The outer surface of the medium transporting means is constructed with a dielectric sheet made of polyvinylidene fluoride, for example. A medium attracting charger as charge applying means is provided on the inner side of the medium transporting means. Outside the medium transporting means, a tubular electrode roller, electrically earthed, is disposed in opposition to the paper attracting charger with respect to the medium transporting means.

In the medium attracting means, the medium attracting charger supplies charge to the medium transporting means. An electric field is formed in a medium attracting region where the medium transporting means is opposed to the electrode roller. Charge of which the polarity is opposite to that of the charge of the medium transporting means is induced into the electrode roller. The image recording medium is fed into the medium attracting region while being guided by a guide member. The image recording medium, which is brought into the electrode roller, receives the electrode roller, and is electrostatically attracted to the medium transporting means being charged in the polarity opposite to that of the charge of the image recording medium.

In the image forming apparatus, in transferring the toner images onto the image recording medium, it is necessary to register these toner images with high precision. The image forming apparatus in which reference images are directly transferred onto the surface of the medium transporting means, and the transferring positions of the toner images are adjusted using the transferred reference images is known. Means to adjust a density of each toner image in which a reference pattern image is formed and directly transferred onto the medium transporting means, and a detecting means, e.g., a CCD sensor, detects a density of the toner image, is also known. After the positions and the densities of such toner images are detected, the toner images are removed by cleaning means including a blade, a roller and the like, located downstream of the image forming stage. Also during the process of forming images, toner charged in low level and toner charged in the opposite polarity are transferred onto a nonimage area on each photoreceptor, and the transferred toner are occasionally transferred onto the surface of the medium transporting means. This type of the toner is also removed by the cleaning means.

These conventional image forming apparatuses have the following disadvantages.

The toner attached to the surface of the medium transporting means is frequently incompletely removed by the cleaning means, and hence left thereon after it passes the cleaning means. Particularly, as disclosed in Japanese Patent Unexamined Publication No. Sho 62-51530, at the joint portion of the dielectric sheet where it is jointed, it is very difficult to completely remove the toner attached thereto. Accordingly, insufficient removal of toner is frequent. With the circulative turn of the medium transporting means, the toner left on the joint portion reaches the medium attracting region, and sometimes is transferred to the electrode roller. Let use consider a case where a voltage for attracting the image recording medium is applied between the electrode of the medium attracting charger and the electrode roller when the image recording medium is present in the medium attracting region, and the same voltage is also applied when the image recording medium has gone by the medium attracting region and is not present there. In this case, when the image recording medium is not present in the medium attracting region, an intensive electric field generated therein causes the toner left on the medium transporting means to go to the electrode roller even when the toner is charged in the direction opposite to the direction of the magnetic field. After one turn of the electrode roller, the toner thus transferred to the electrode roller is transferred again to the surface of the image recording medium when it reaches the medium attracting region. The toner transferred to the medium surface causes a defective image.

One of possible ways to prevent the residual toner from attaching to the electrode roller is to bring the electrode roller into contact with the medium transporting means only when the image recording medium is attracted, and to retract it from the medium transporting means when it is not attracted. When the electrode roller is brought into contact with the medium transporting means and is retracted therefrom, a load of the medium transporting means varies. The load variation leads to deterioration of the image quality.

There is a proposal to solve the unsatisfactory removal of toner. In the proposal, to smooth the surface of the medium transporting means, the joint portion on the medium transporting means is covered with a tape. The proposal is unsatisfactory in durability and hence needs much maintenance, however.

SUMMARY OF THE INVENTION

The present invention has been made in view of the above circumstances and has an object to provide an image forming apparatus which is free from such a disagreeable situation that the residual toner on the medium transporting means attaches to the electrode roller and then to the image recording medium, and hence can form a quality image.

To solve the above problems, an image forming apparatus according to a first aspect of the invention comprises:

medium transporting means for carrying an image recording medium on a surface thereof;

means for driving the medium transporting means so that the surface thereof is circulatively turned;

a plural number of toner image forming means disposed facing the medium transporting means, each of the toner image forming means including: image bearing means the surface of which an electrostatic latent image is to be formed, a developing unit for developing the electrostatic latent image into a toner image by applying toner to the electrostatic latent image, and an image transferring unit for transferring the toner image on the medium transporting means or an image recording medium held on the medium transporting means;

medium supplying means for successively supplying image recording media to the medium transporting means;

a medium attracting electrode being disposed facing the medium transporting means;

a counter electrode being disposed in opposition to the medium attracting electrode with respect to the medium attracting electrode;

a power source for applying a voltage between the medium attracting electrode and the counter electrode; and control means for controlling an output of the power source.

In the image forming apparatus, an electric field is formed between the medium attracting electrode and the counter electrode, to thereby cause the medium transporting means to attract the image recording medium to the medium transporting means per se. The image forming apparatus thus constructed is improved in that the control means controls the voltage, which is applied from the power source between the medium attracting electrode and the counter electrode, in such a manner that an electric field, which is formed between the medium attracting electrode and the counter electrode when the image recording medium is not interposed between the medium attracting electrode and the counter electrode, is weaker than an electric field formed therebetween when the image recording medium is interposed therebetween, and has such a direction as to cause the medium transporting means to attract the toner to the medium transporting means per se.

The image forming apparatus according to a second aspect of the invention specifies the apparatus of the first aspect of the invention such that when the image recording medium is not interposed between the medium attracting electrode and the counter electrode, no voltage is applied between the medium attracting electrode and the counter electrode.

In the image forming apparatus of the third aspect of the invention, the apparatus of the first or second aspect of the invention further comprises a sensor for detecting a reference mark attached to the medium transporting means. In the apparatus, the medium supplying means places an image recording medium at a predetermined location on the medium transporting means in accordance with an output signal of the sensor, and the control means controls a value of the output from the power source at a timing based on an output signal of the sensor.

The image forming apparatus according to the fourth aspect of the invention specifies the apparatus of the first to third aspects of the invention such that the medium transporting means takes the form of an endless belt or a drum, and the medium supplying means supplies an image recording medium onto the medium transporting means so as to place the medium at a location other than a joint portion of the medium transporting means.

An image forming apparatus according to a fifth aspect of the invention, comprises:

medium transporting means for carrying an image recording medium on a surface thereof;

means for driving the medium transporting means so that surface thereof is circulatively turned;

a plural number of toner image forming means disposed facing the medium transporting means, each of the toner image forming means including an image bearing means the surface of which an electrostatic latent image is to be formed, a developing unit for developing the electrostatic latent image into a toner image by applying toner to the electrostatic latent image, and an image transferring unit for transferring the toner image on the medium transporting means or an image recording medium held on the medium transporting means;

medium supplying means for successively supplying image recording media to the medium transporting means;

a medium attracting electrode being disposed facing the medium transporting means;

a counter electrode being disposed in opposition to the medium attracting electrode with respect to the medium attracting electrode; and a power source for applying a voltage between the medium attracting electrode and the counter electrode.

In the image forming apparatus, an electric field is formed between the medium attracting electrode and the counter electrode, to thereby cause the medium transporting means to attract the image recording medium to the medium transporting means per se. The image forming apparatus thus constructed is improved in that the counter electrode is constructed with a tubular member, which is rotatable facing the outer surface of the medium transporting means, the medium transporting means takes the form of an endless belt or a drum, and the medium supplying means supplies an image recording medium onto the medium transporting means so as to place the medium at a location other than a joint portion of the transporting belt and a portion on the transporting belt, spaced downstream from the joint portion by a distance corresponding to the peripheral length of the counter electrode.

In the first aspect of the invention, any arrangement of the medium attracting electrode, the counter electrode and the power source may be used if it can apply a proper voltage between the medium attracting electrode and the counter electrode. For example, the counter electrode may be earthed. In this case, a voltage applied to the medium attracting electrode is controlled. Alternatively, a voltage applied to the medium attracting electrode may be controlled. It is desirable that the voltage applied between the medium attracting electrode and the counter electrode is determined depending on the polarity of the charged toner and the surface potential of the medium transporting means. The medium attracting electrode may take any form if it is capable of properly charging the medium transporting means. An example of it is a corotron. The same thing is true for the counter electrode. A tubular electrode, driven in the same direction as the direction in which the medium transporting means is moved, is preferable for the counter electrode, in order to prevent the medium transporting means from being damaged.

In the image forming apparatuses according to the first and second aspect of the invention, the voltage applied between the medium attracting electrode and the counter electrode when the image recording medium is interposed therebetween is different from that when the recording medium is not interposed (in the apparatus of the second aspect of the invention, the voltage is 0). Accordingly, the electric fields developed therebetween by those voltages are different. An electric field developed when the recording medium is not interposed is weaker than that when it is interposed, and has a direction to cause the toner on the medium transporting means to move to the image recording medium. Therefore, when the toner, which is left on the medium transporting means as the result of an incomplete cleaning, comes in contact with the counter electrode, the toner is left attracted to the medium transporting means and not transferred to the counter electrode. For this reason, when the image recording medium is transported to and reaches medium attracting region, no toner is transferred from the counter electrode to the image recording medium. As a result, the image quality is not deteriorated.

The image forming apparatus according to the third aspect of the invention includes a sensor for detecting a reference mark attached to the medium transporting means, and the medium supplying means supplies the image recording medium to the medium transporting means on the basis of the output signal of the sensor. The image recording medium is supplied at preset timings and placed at a predetermined location on the medium transporting means. The control means, further included, controls a value of the output from the power source at a timing based on an output signal of the sensor. In an area on the medium transporting means where the image recording medium is not located, the output of the power source may be set at a value different from that of the output when the recording medium is not attracted. Accordingly, the output of the power source may be properly controlled depending on the presence and absence of the recording medium. The control like that by the first aspect of the invention is ensured.

In the image forming apparatus according to the fourth aspect of the invention, the medium transporting means takes the form of an endless belt or a drum, and the image recording medium is supplied onto the medium transporting means so as to place the medium at a location other than a joint portion of the medium transporting means. With this construction, when the joint portion passes between the medium attracting electrode and the counter electrode, a state that the recording medium is not interposed is always set up. At this time, the voltage applied to between the medium attracting electrode and the counter electrode is controlled, so that such an electric field as to cause the medium transporting means to attract toner thereto is developed therebetween. Accordingly, even if the cleaning work by the cleaning means is incomplete and the toner is left on the joint portion and its near portion, the residual toner is not transferred to the counter electrode. Accordingly, the image quality deterioration by the paper soiling by the residual toner will never take place.

The counter electrode is constructed with a tubular member, which is rotatable facing the outer surface of the medium transporting means. Therefore, after one turn of the counter electrode, the toner, which is left on at the joint portion or its near portion on the medium transporting means is transferred onto the counter electrode, is brought into contact with the medium transporting means, and attaches to the surface of the medium transporting means again. In this case, the toner that was transferred on the counter electrode is not transferred to the image recording medium if it comes in contact with the medium transporting means after one turn of the counter electrode, however, since the medium supplying means supplies an image recording medium onto the medium transporting means so as to place the medium at a location other than a joint portion of the transporting belt and a portion on the transporting belt, spaced downstream from the joint portion by a distance corresponding to the peripheral length of the counter electrode. Accordingly, the image quality is not deteriorated. The toner that is transferred from the counter electrode to the medium transporting means again is removed when it passes the cleaning means. Accordingly, if the toner attaching to the joint portion on the medium transporting means is transferred to the counter electrode, the image recording medium is not soiled with the transferred toner. The image quality deterioration is not caused. If the toner is transferred again to the medium transporting means after one turn of the counter electrode, the recording medium is not located at this portion and hence it is not soiled with toner.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

The preferred embodiments of the present invention will be described with reference to the accompanying drawings.

Figure 1:
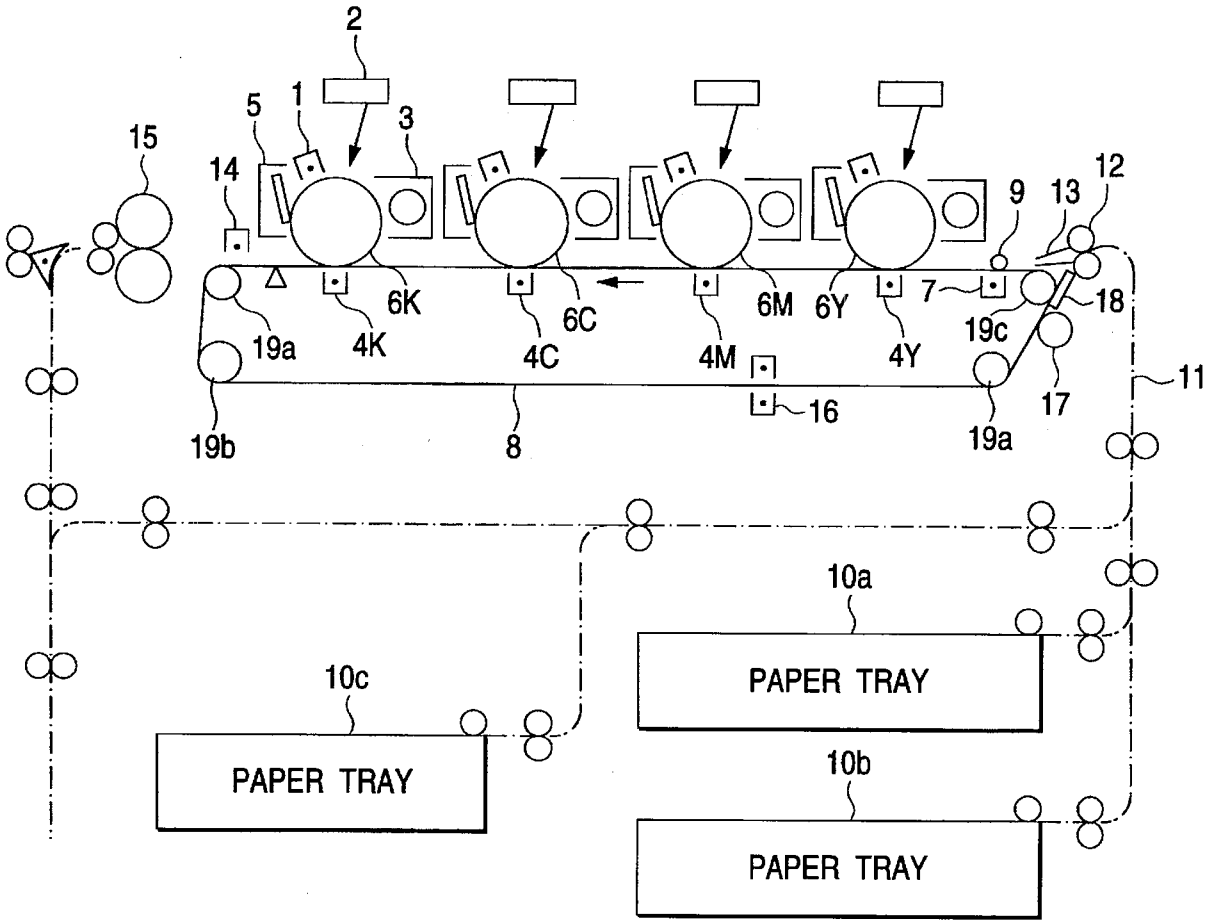
FIG. 1 is a diagram schematically showing the construction of an image forming apparatus according to an embodiment of the present invention.
Figure 2:
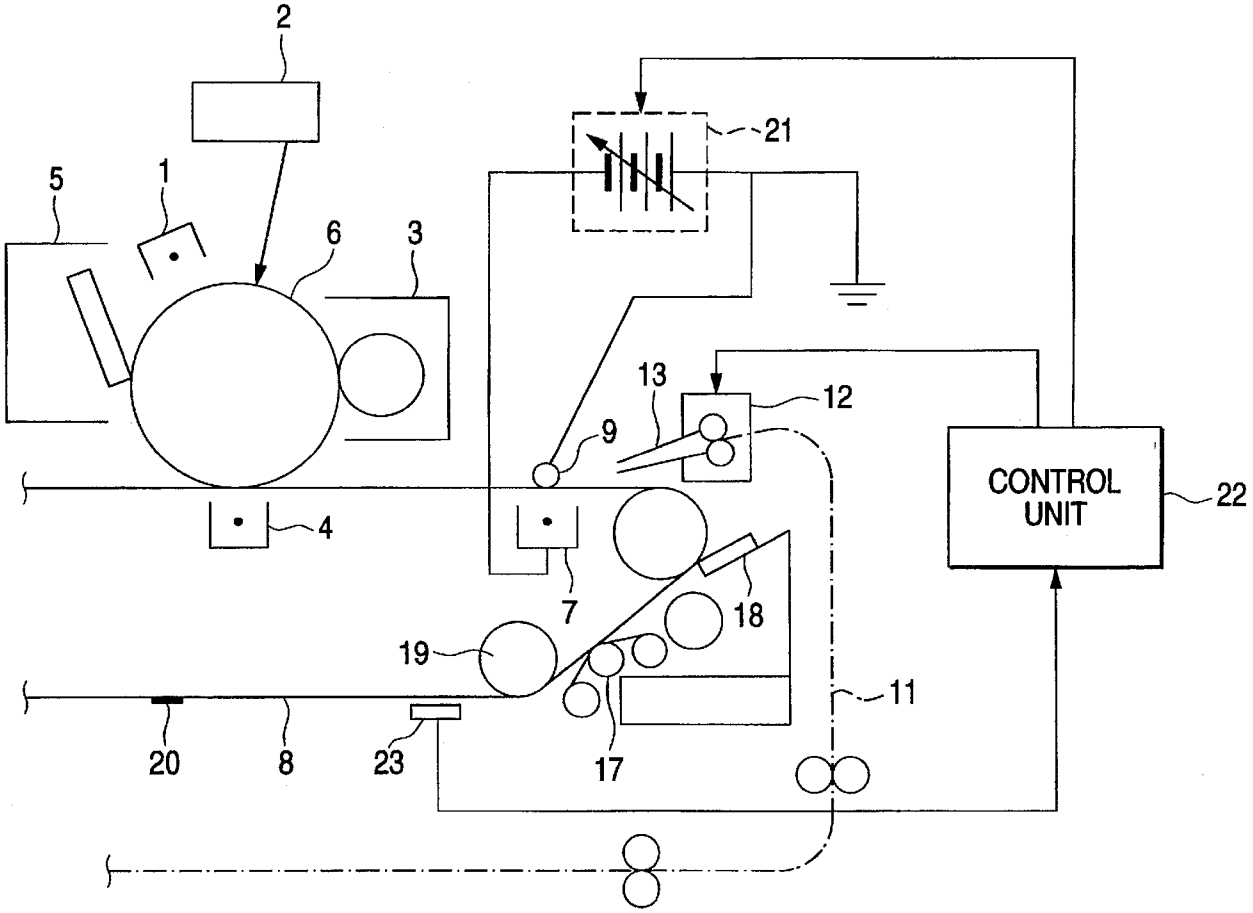
FIG. 2 shows, in block and schematic form, a paper attracting section and its near portions in the image forming apparatus shown in FIG. 1.

FIG. 1 is a diagram schematically showing the construction of an image forming apparatus according to an embodiment of the present invention. FIG. 2 shows, in block and schematic form, a paper attracting section and its near portions in the image forming apparatus shown in FIG. 1.

The image forming apparatus includes a transporting belt (medium transporting means) 8 that transports an image recording paper (referred to as a paper) in a fixed direction while electrostatically holding the paper, and four photoreceptors 6Y, 6M, 6C and 6K each taking the form of a drum, which are disposed along and in proximity with the transporting belt 8. Disposed along the surface of each photoreceptor drum 6 are a charger 1 for uniformly charging the surface of the photoreceptor drum, an image writing unit 2 for forming an electrostatic latent image on the surface of the photoreceptor drum by projecting laser beams onto the surface thereof, a developing unit 3 for developing the electrostatic latent image into a visual or toner image by applying toner thereto, an image transferring unit 4 for transferring the toner image onto the paper, and a cleaning unit 5 for removing toner still left on the surface of the photoreceptor drum after the transferring of the toner image ends.

The image forming apparatus further includes paper trays 10*a*, 10*b* and 10*c* for containing stacks of papers, a paper transporting path 11 for transporting the papers that are picked up sheet by sheet from each paper tray, a paper feed roller pair 12 for sequentially feeding the papers onto the transporting belt 8, a paper guide 13 for guiding the paper to a paper feeding position, a paper attracting corotron 7 disposed downstream of the paper guide and on the rear side of the transporting belt 8, and an electrode roller means 9 disposed in opposition to the paper attracting corotron 7 with respect to the transporting belt 8. Additionally, in the image forming apparatus, a paper peeling-off means 14 for peeling off the paper from the transporting belt 8, and a fixing unit 15 for fixing the toner image onto the paper after it is peeled off are located downstream of the four image transferring units 4. A charge removal device 16 for removing the charge left on the transporting belt 8, and a cleaning roller 17 and a cleaning blade 18 for cleaning the surface of the transporting belt 8, which are further included in the image forming apparatus, are disposed downstream of the paper peeling-off means 14 when viewed in the moving direction of the transporting belt 8.

As shown in FIG. 2, the paper attracting corotron 7 is connected to a power source 21 for applying a voltage between the corotron and the electrode roller means 9. A control unit 22 is provided for controlling the output voltage of the power source 21.

The developing unit 3 uses toner of different colors. In the embodiment, these colors are yellow, cyan, magenta, and black. The toner of these colors are charged negatively.

The transporting belt 8 consists of a transparent dielectric sheet of high resistance, made of polyethylene terephthalate, polyvinylidene fluoride, polycarbonate or the like. The transporting belt 8 is supported by four supporting rollers 19*a* to 19*d*, and may be circulated in the direction of an arrow shown in the drawing.

Figure 3:
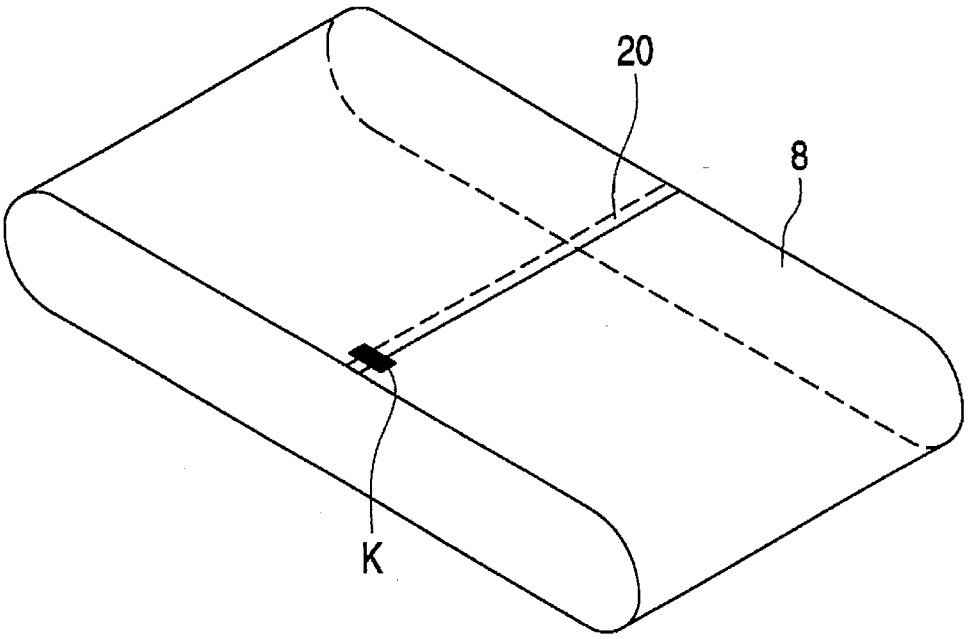
FIG. 3 is a diagram showing a reference mark on the transporting belt in the image forming apparatus shown in FIG. 1.
Figure 4:
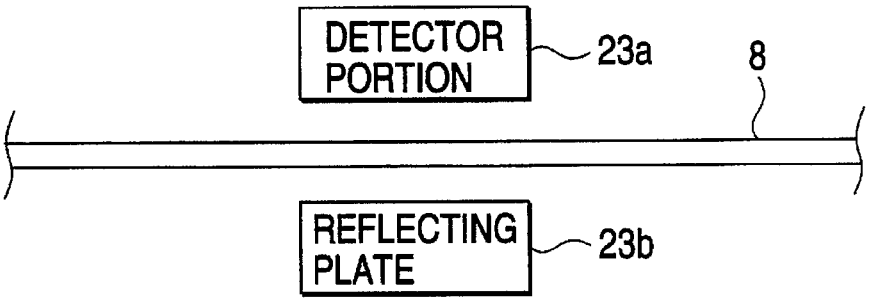
FIG. 4 is a diagram showing the construction of a sensor used in the image forming apparatus shown in FIG. 1.

As shown in FIG. 3, a reference mark K, used to determine the paper locating position, is attached to a joint portion 20 of the transporting belt 8. A sensor 23 for detecting the reference mark K is provided upstream of the paper feeding position of the transporting belt 8. As shown in FIG. 4, the sensor 23 is formed of a detector portion 23*a* including a light emitting element and a photo sensing element, and a reflecting plate 23*b* disposed in opposition to the detector portion 23*a* with respect to the transporting belt 8. In the sensor, the light emitting element emits light, the reflecting plate reflects the light therefrom, and the photo sensing element receives the light from the reflecting plate, whereby the sensor detects the reference mark K on the transporting belt 8. The feed roller pair 12 receives the output signal of the sensor 23 to supply the paper onto the transporting belt 8 at a time point based on the output signal. The thus fed paper is placed at a given location on the transporting belt 8.

The electrode roller means 9 is made of conductive material and electrically earthed. The electrode roller is supported so that the outer surface thereof comes in contact with the surface of the transporting belt 8. The electrode roller is rotatable in the same direction as the moving direction of the transporting belt 8.

The power source 21 applies a voltage between the paper attracting corotron 7 and the electrode roller means 9. The applied voltage is variable.

The control unit 22 controls a value of an output from the power source 21 at a timing that is determined in accordance with the output signal of the sensor 23. More specifically, a value of the output, which is outputted from the power source 21 when an image recording paper is interposed between the paper attracting corotron 7 and the electrode roller means 9, is different from that produced when the paper is not interposed therebetween. When the paper is interposed between the paper attracting corotron 7 and the electrode roller means 9, the output is set at such a value as to develop an electrical field therebetween, which is high enough to enable the transporting belt 8 to electrostatically attract the paper to the belt itself. In this case, the output value is controlled so that a current injected into the electrode roller means 9 is approximately 7 μA in the present embodiment. When the paper is not interposed, the output of the power source is set at such a value as to produce an electric field, which is weaker than the electric field developed when the transporting belt attracts the paper to the belt per se, and has such as a direction as to cause the transporting belt 8 to attract the toner to the belt per se. In this case, the output value is controlled so that the current injected into the electrode roller means 9 is approximately 3 μA in the embodiment.

The operation of the image forming apparatus thus constructed will be described.

The surfaces of the photoreceptors 6Y, 6M, 6C and 6K are uniformly charged with a laser beam containing image information, which is emitted from the image writing unit 2. As a result, electrostatic latent images are formed on the surfaces of the photoreceptors. Each of these latent images is developed into a toner image by the related developing unit 3, and moved to the position opposed to the related image transferring unit 4, with turn of the photoreceptor.

Figure 5:
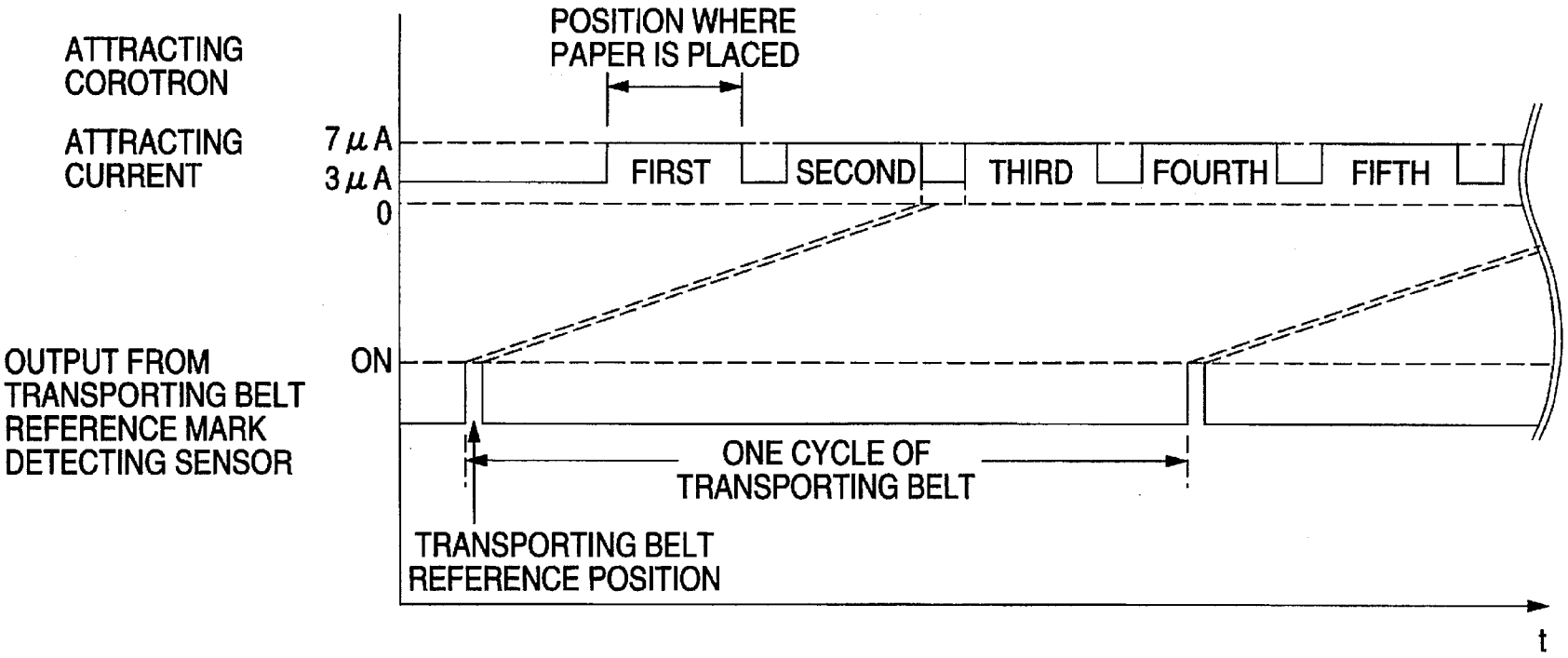
FIG. 5 is a chart showing the outputting timing of the paper attracting corotron in the image forming apparatus shown in FIG. 1.

A paper, taken out of one of the paper trays 10*a*, 10*b* and 10*c* sheet by sheet, is transported through the paper transporting path 11 and reaches the location of the feed roller pair 12. At this time, the transporting belt 8 is driven to start its circulative turn. The sensor 23 detects the reference mark K on the transporting belt 8. In response to an output signal from the sensor 23, the control unit 22 drives the feed roller pair 12 and controls the output value of the power source 21 and the timing of the outputting by it. Specifically, as shown in FIG. 5, the feed roller pair 12 feeds the paper so that it will be placed at a predetermined location on the transporting belt 8. The power source 21 applies voltage to the paper attracting corotron 7 in synchronism with the paper feeding by the feed roller pair. The voltage applied is set at such a value as to cause the current of approximately 7 μA to flow into the electrode roller means 9. As a result, charge is given to the transporting belt 8, from the paper attracting corotron 7, while the charge opposite in polarity to that given to the transporting belt is induced in the electrode roller means 9. The paper interposed between the paper attracting corotron 7 and the electrode roller means 9 receives charge from the electrode roller means 9, and is electrostatically attracted to the transporting belt 8 already charged in the polarity that is opposite to that of the paper. As shown in FIG. 5, the paper is placed at a location out of the joint portion 20 on the transporting belt.

The paper, which is attracted onto the transporting belt 8, is carried to pass successively the image transferring units 4Y, 4M, 4C and 4K with the circulative turn of the transporting belt, and receives a toner image of yellow from the image transferring unit 4Y, a toner image of magenta from the image transferring unit 4M, a toner image of cyan from the image transferring unit 4C, and a toner image of black from the image transferring unit 4K. Thereafter, the paper is peeled off from the transporting belt 8 by the paper peeling-off means 14, and the toner image is pressurized and fused to be fixed on the paper. The transporting belt 8 now not having the paper thereon is processed by the charge removal device 16, so that the residual charge is removed. Further, the transporting belt 8 undergoes a cleaning process by the cleaning roller 17 and the cleaning blade 18, so that the toner left on the belt is removed, and thereafter reaches the location between the paper attracting corotron 7 and the electrode roller means 9.

Figure 6:
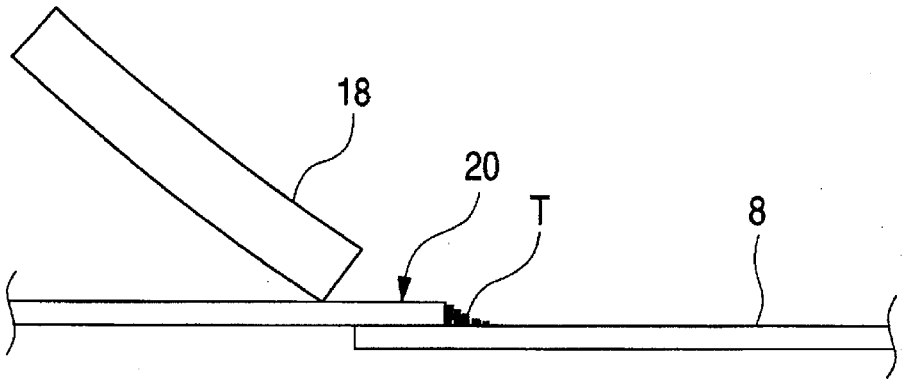
FIG. 6 is a diagram showing the toner left at the joint portion and its near portion on the transporting belt in the image forming apparatus shown in FIG. 1.

In the image forming process as referred to above, when no paper is interposed between the paper attracting corotron 7 and the electrode roller means 9, a voltage, which is different from the voltage causing the transporting belt to attract the paper to the belt per se, is applied to the paper attracting corotron 7, from the power source 21 at the timing shown in FIG. 5. The voltage applied by the power source 21 has such a value as to cause current of approximately 3 μA to flow into the electrode roller means 9. An electric field, which is developed by the applied voltage between the paper attracting corotron 7 and the electrode roller means 9, is weaker than the voltage causing the transporting belt to attract the paper to the belt per se and has the direction to cause the transporting belt 8 to attract the toner to the belt per se. The transporting belt undergoes the cleaning process by the cleaning roller 17 and the like, but toner attached to it is frequently incompletely removed from the surface of the transporting belt 8, and the toner left thereon reaches the location where it faces the electrode roller means 9. In this case, the electric field formed in this location causes the transporting belt 8 to attract the residual toner to the belt per se. In other words, the construction in question prevents the residual toner from going to the electrode roller means 9. As shown in FIG. 6, toner T tends to stay at a portion near to the joint portion 20 on the transporting belt 8. The toner T is frequently left on the transporting belt 8 even after it undergoes the cleaning process by the cleaning blade 18. In this case, however, the residual toner T is not transferred to the electrode roller means 9. Accordingly, the paper will not be soiled with the residual toner if it is attracted to the transporting belt. As a result, an image less suffering from quality deterioration can be formed on the paper.

In present embodiment, when the paper is not interposed between the paper attracting corotron 7 and the electrode roller means 9, the output voltage of the power source 21 is controlled so that the current flowing into the electrode roller means 9 is approximately 3 μA. The current may also be set at 0 μA. The transporting belt 8 is charged, by the four charging units 4, to have a potential of which the polarity is opposite to that of the charge of the toner. After it passes the charge removal device 16, the potential of the transporting belt 8 is not reduced to zero, viz., the transporting belt 8 has still an appreciable potential. When the transporting belt 8 passes the location where it faces the electrode roller means 9, the residual toner is attracted to the transporting belt 8 since the transporting belt 8 is in the thus charged state. As a result, no toner is transferred to the electrode roller means 9.

In the embodiment, the reference mark K is affixed to the joint portion 20 of the transporting belt 8, but it may be affixed to any other location than the joint portion 20. In this case, the feed roller pair 12 is driven so as to place the paper at a location out of the joint portion 20 on the transporting belt.

Figure 7:
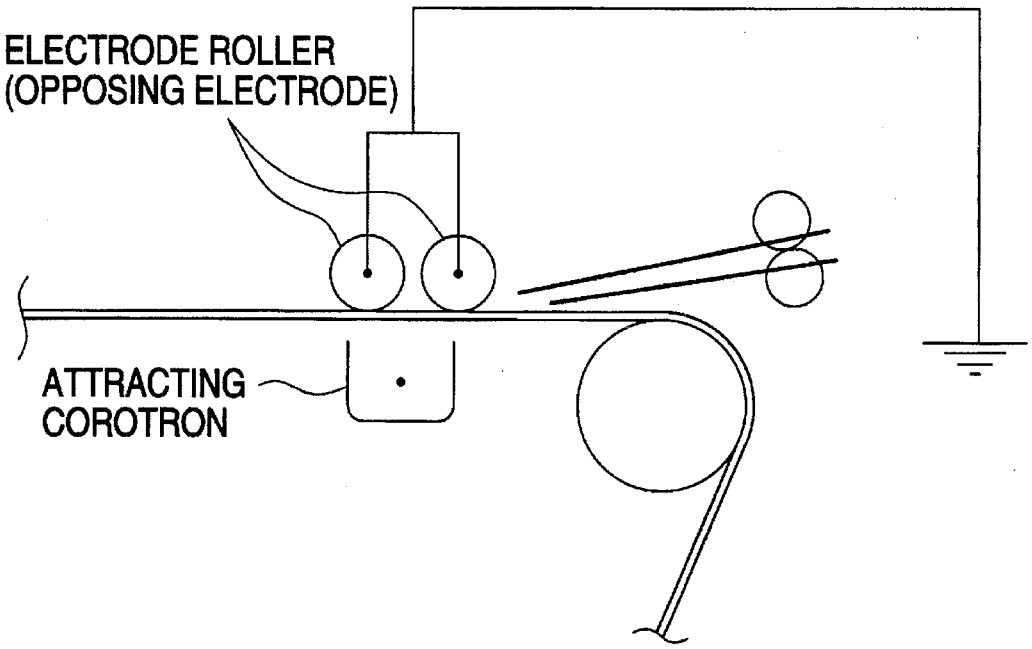
FIG. 7 is a diagram showing another electrode roller means used in the image forming apparatus.
Figure 8:
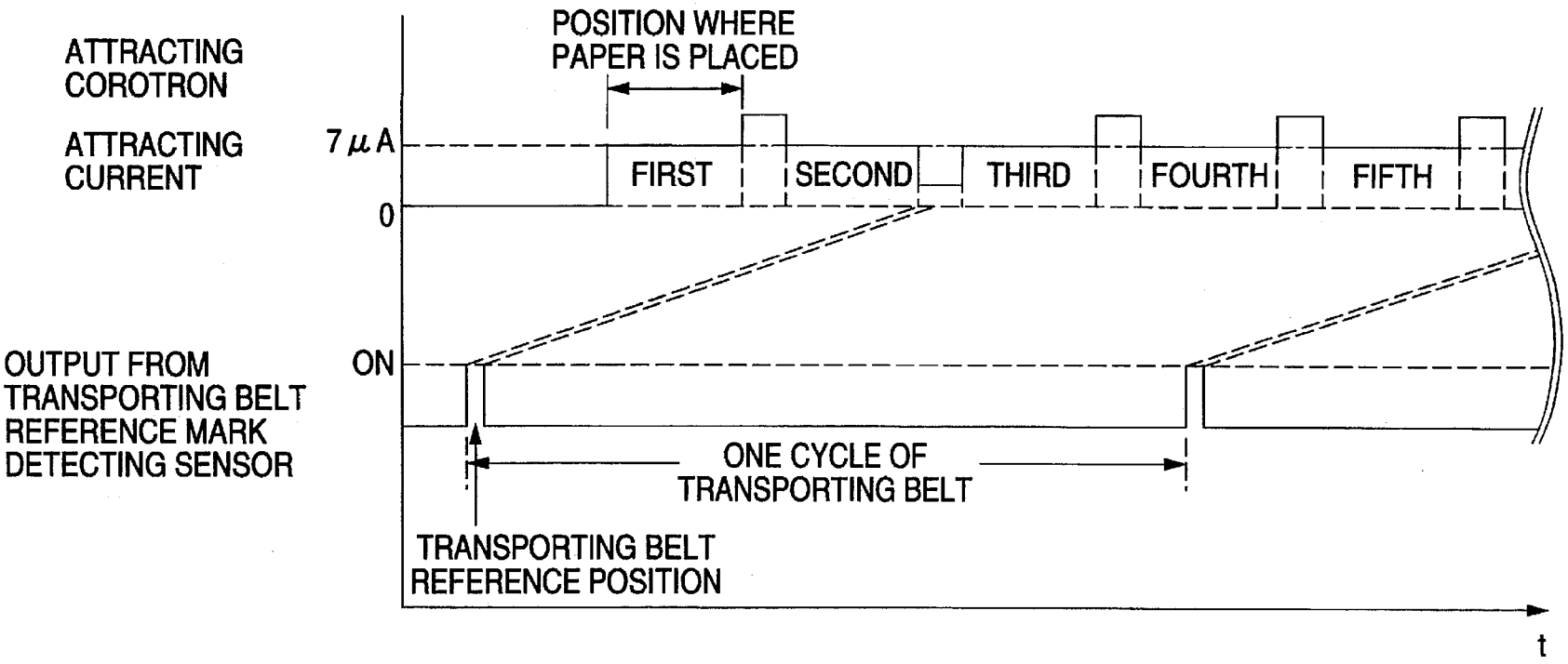
FIG. 8 is a chart showing the outputting timing of the paper attracting corotron in an image forming apparatus according to another embodiment of the invention.

While the electrode roller means 9 consists of one tubular roller in the embodiment, two or more number of tubular rollers may be used for the electrode roller means, as shown in FIG. 7. FIG. 8 is a chart showing the timings of producing an output from a power source to a paper attracting corotron in an image forming apparatus according to another embodiment of the invention.

The construction of this image forming apparatus is substantially equal to that of the image forming apparatus shown in FIG. 1, but a value of an output, which is produced from the power source 21 when the paper is not interposed between the paper attracting corotron 7 and the electrode roller means 9, is different from that in the FIG. 1 apparatus. Specifically, as shown in FIG. 8, when the joint portion (reference position) on the transporting belt 8 passes the location where it faces the electrode roller means 9, the output produced from the power source is controlled so as to cause current of approximately 3 μA to flow to the electrode roller means 9. When the joint portion passing there is not present, the output produced from the power source is set at such a value as to cause the current which is larger than the current caused when the paper is interposed therebetween.

Accordingly, when the joint portion passes the electrode roller means, the toner attached to the joint portion and its near portion is not transferred to the electrode roller means 9, whereby the image is free from its quality deterioration problem. A reference image for detecting an optical density is transferred onto other portions each between the paper locating areas than the joint portion on the transporting belt, and these portions are charged in advance by the paper attracting corotron, whereby a charge potential of the transporting belt is adjusted when it is located to face the image transferring unit. It is estimated that a small amount of toner is left on the other portions than the joint portion on the transporting belt. Accordingly, if the current to flow to the electrode roller means is set at a high value, the paper soiling problem is rarely invited.

Figure 9:
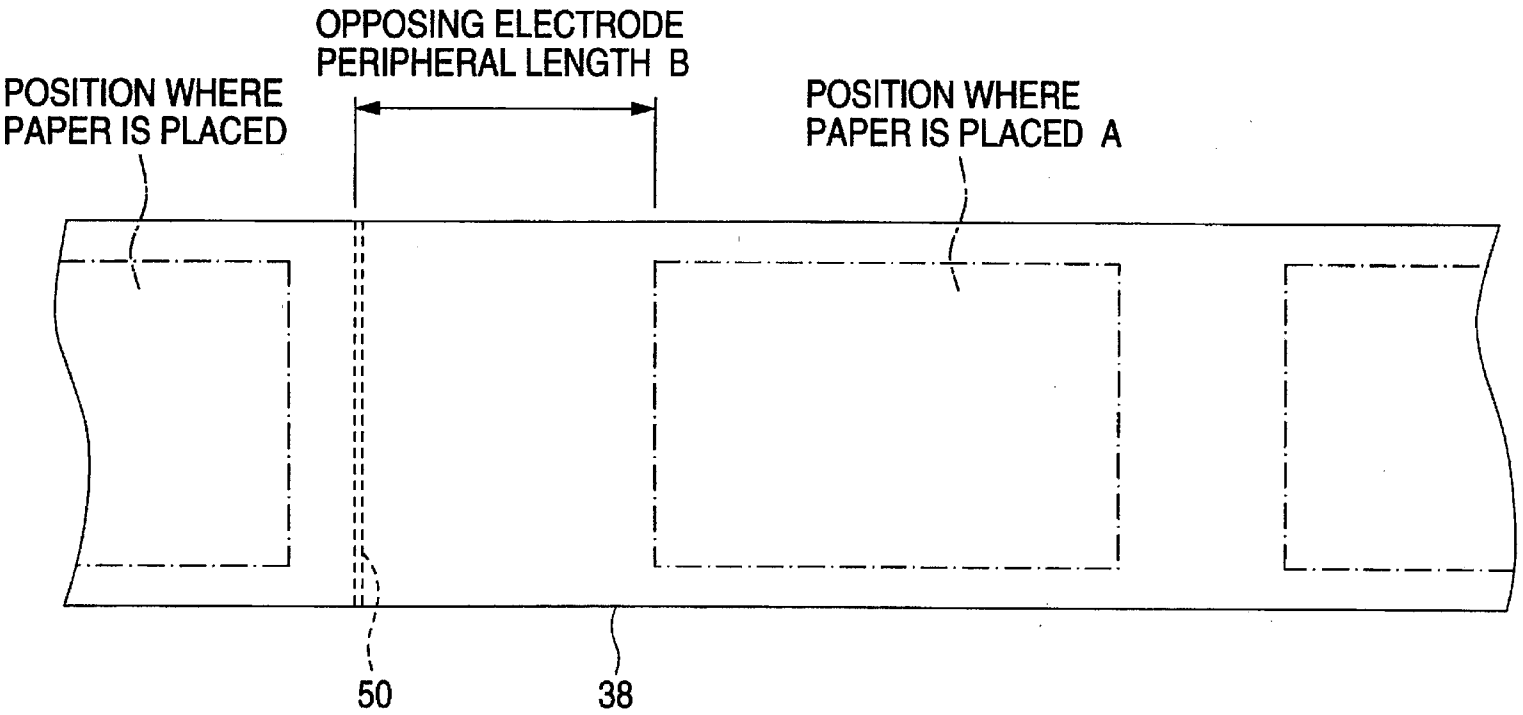
FIG. 9 is a diagram showing how an image recording paper is placed on the transporting belt in the image forming apparatus according to the embodiment of the invention.

FIG. 9 is a diagram showing how an image recording paper is placed on the transporting belt in the image forming apparatus according to the embodiment of the invention. FIG. 10 is a diagram showing the operation to feed the paper to the transporting belt in the image forming apparatus.

The construction of this image forming apparatus is substantially equal to that of the image forming apparatus shown in FIG. 1, but the timing of feeding the paper by the feed roller is different from that in the FIG. 1 apparatus, and as shown in FIG. 9, portions A where the paper to be fed to a paper transporting belt 38 is placed are laid out in different areas on the transporting belt. When the sensor detects a joint portion 50 on the transporting belt 38, the feed roller is driven, by an output signal of the sensor, to feed an image recording paper and place the paper on a portion on the transporting belt, spaced downstream from the joint portion 50 by a distance corresponding to the peripheral length B of the electrode roller means 39. When a paper is placed on the transporting belt and the joint portion 50 of the transporting belt 38 passes the sensor, the next paper is placed on a downstream portion on the transporting belt 38 after the transporting belt is moved a distance equal to the length of the portion corresponding to the peripheral length of the electrode roller means 39.

Figure 10A:
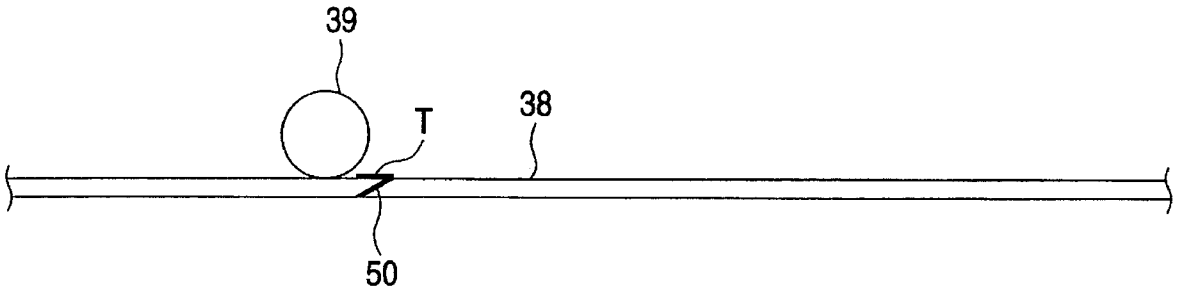
FIGS. 10A to 10C are diagrams showing states how an image recording paper is fed onto the transporting belt in the image forming apparatus according to the embodiment of the invention.
Figure 10B:
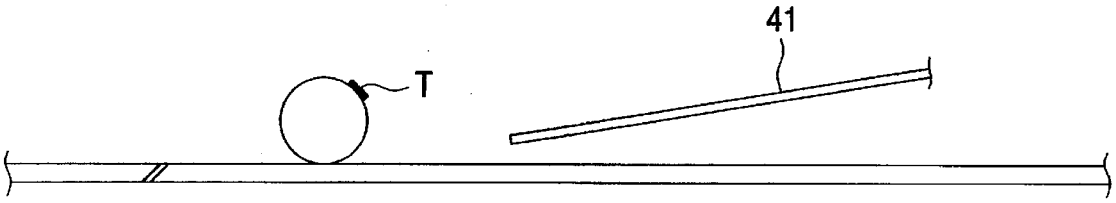
Figure 10C:
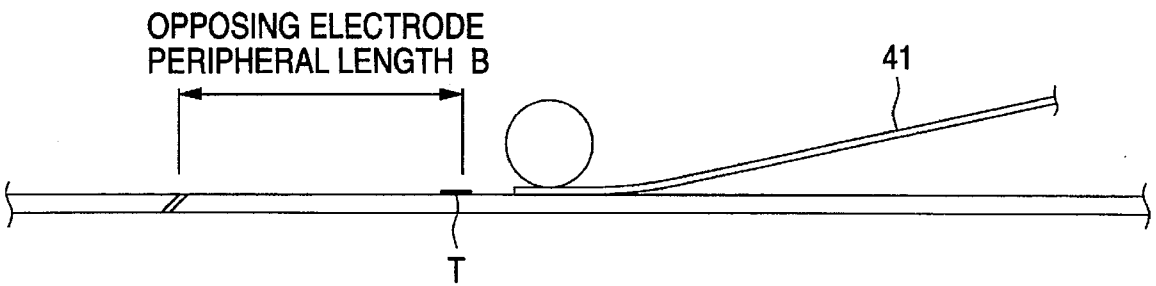

In the image forming apparatus thus constructed, with the circulative turn of the transporting belt 38, toner T attached to the joint portion 50 is moved to the location where it faces the electrode roller means 39, as shown in FIG. 10A. At the location, the toner T is transferred to the electrode roller means 39 as shown in FIG. 10B. Thereafter, the electrode roller means 39 is rotated by one turn, and the toner T is transferred to the transporting belt 38 again, as shown in FIG. 10C. At this time, a paper 41 is placed on a portion on the transporting belt, spaced downstream from the joint portion by the distance corresponding to the peripheral length of the electrode roller means 39. Accordingly, the toner transferred onto the transporting belt 38 will not attach to the paper 41. Therefore, the image on the paper is not deteriorated in quality, and a quality image is secured. The toner that has been transferred onto the transporting belt 38 as shown in FIG. 10C may be removed by the cleaning roller, for example, with the circulative turn of the transporting belt 38.

In the image forming apparatuses according to the first aspect of the invention, when the toner that is left on the medium transporting means is transported and comes in contact with the counter electrode, the toner is attracted to the medium transporting means under an electric field developed between the medium attracting electrode and the counter electrode, so that it is not transferred to the counter electrode. For this reason, when the image recording medium is transported to and reaches medium attracting region, it is not soiled with toner, and hence the image quality is not deteriorated.

In the image forming apparatus according to the third aspect of the invention, the sensor detects a reference mark attached to the medium transporting means, and the image recording medium is supplied on the basis of the output signal of the sensor. Accordingly, the image recording medium can be placed at a predetermined location on the medium transporting means. At the timings based on an output signal of the sensor, a value of the output of the power source may be varied depending on whether or not a location where the image recording medium is to be placed on the medium transporting means. Accordingly, the output of the power source can be properly controlled depending on the presence or absence of the image recording medium. The residual toner is never transferred to the counter electrode.

In the image forming apparatus according to the third aspect of the invention, the image recording medium is supplied onto the medium transporting means so as to place the medium at a location other than a joint portion of the medium transporting means where a front end of the medium transporting means is joined to a rear end thereof. With this construction, when the joint portion passes between the medium attracting electrode and the counter electrode, a state that the recording medium is not interposed is always set up. Accordingly, by developing such an electric field as to cause the medium transporting means to attract toner thereto between the medium attracting electrode and the counter electrode, the toner that is still left on the joint portion and its near portion after the cleaning process is not transferred to the counter electrode. Therefore, there is no chance that the toner is attached to the recording medium through the counter electrode. A more reliable prevention of the image quality deterioration is secured.

In the image forming apparatus according to the fourth aspect of the invention, if the toner left at the joint portion and its near portion is transferred to the counter electrode and, with the turn of the counter electrode, it is transferred onto the medium transporting means, the toner is not transferred to the recording medium since the image recording medium is supplied onto the medium transporting means so as to place the medium at a location other than a joint portion of the transporting belt and a portion on the transporting belt, spaced downstream from the joint portion by a distance corresponding to the peripheral length of the counter electrode. Accordingly, if the toner attaching to the joint portion on the medium transporting means is transferred to the counter electrode, the image recording medium is not soiled with the transferred toner, and the image quality deterioration is not caused.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

medium transporting means for carrying an image recording medium on a surface thereof;

means for driving said medium transporting means so that the surface thereof is circulatively turned;

a plural number of toner image forming means disposed facing said medium transporting means, each of said toner image forming means including an image bearing means the surface of which an electrostatic latent image is to be formed, a developing unit for developing the electrostatic latent image into a toner image by applying toner to the electrostatic latent image, and an image transferring unit for transferring the toner image on said medium transporting means or an image recording medium held on said medium transporting means;

medium supplying means for successively supplying image recording media to said medium transporting means;

a medium attracting electrode being disposed facing said medium transporting means;

a counter electrode being disposed in opposition to said medium attracting electrode with respect to said medium attracting electrode;

a power source for applying a voltage between said medium attracting electrode and said counter electrode; and control means for controlling an output of said power source;

wherein an electric field is formed between said medium attracting electrode and said counter electrode, to cause said medium transporting means to attract the image recording medium to said medium transporting means per se;

wherein said control means controls the voltage, which is applied from said power source between said medium attracting electrode and said counter electrode, in such a manner that any electric field, which is formed between said medium attracting electrode and said counter electrode when the image recording medium is not interposed between said medium attracting electrode and said counter electrode, is weaker than an electric field formed therebetween when the image recording medium is interposed therebetween, and has such a direction as to cause said medium transporting means to attract the toner to said medium transporting means per se.

2. An image forming apparatus according to claim 1, wherein when the image recording medium is not interposed between said medium attracting electrode and said counter electrode, no voltage is applied between said medium attracting electrode and said counter electrode.

3. An image forming apparatus according to claim 1, further comprising: a sensor for detecting a reference mark attached to said medium transporting means;

wherein said medium supplying means places an image recording medium at a predetermined location on said medium transporting means according to an output signal of said sensor, and said control means controls a value of the output from said power source at a timing based on an output signal of said sensor.

4. An image forming apparatus according to claim 1, wherein said medium transporting means takes the form of one of an endless belt and a drum, and said medium supplying means supplies an image recording medium onto said medium transporting means so as to place the medium at a location other than a joint portion of the medium transporting means.

5. An image forming apparatus, comprising:

medium transporting means for carrying an image recording medium on a surface thereof;

means for driving said medium transporting means so that the surface thereof is circulatively turned;

a plural number of toner image forming means disposed facing said medium transporting means, each of said toner image forming means including an image bearing means the surface of which an electrostatic latent image is to be formed, a developing unit for developing the electrostatic latent image into a toner image by applying toner to the electrostatic latent image, and an image transferring unit for transferring the toner image on said medium transporting means or an image recording medium held on said medium transporting means;

medium supplying means for successively supplying image recording media to said medium transporting means;

a medium attracting electrode being disposed facing said medium transporting means;

a counter electrode being disposed in opposition to said medium attracting electrode with respect to said medium attracting electrode; and a power source for applying a voltage between said medium attracting electrode and said counter electrode;

wherein an electric field is formed between said medium attracting electrode and said counter electrode, to cause said medium transporting means to attract the image recording medium to said medium transporting means; and wherein the counter electrode is constructed with a tubular member, which is rotatable facing the outer surface of said medium transporting means, said medium transporting means takes the form of one of an endless belt and a drum, and said medium supplying means supplies an image recording medium onto said medium transporting means so as to place the medium at a location other than a joint portion of the transporting belt and a portion on the transporting belt, spaced downstream from the joint portion by a distance corresponding to the peripheral length of the counter electrode.

* * * * *

UNITED STATES PATENT AND TRADEMARK OFFICE

CERTIFICATE OF CORRECTION

PATENT NO. : 5,629,760

DATED : May 13, 1997

INVENTOR(S) : Yukio HAYASHI et al.

It is certified that error appears in the above-indentified patent and that said Letters Patent is hereby corrected as shown below:

On the cover page, at [30], "Foreign Application Priority Data", change "April 15, 1996" to --April 15, 1995--.

Signed and Sealed this

Twelfth Day of May, 1998

*Attest:*

*Attesting Officer*

BRUCE LEHMAN

*Commissioner of Patents and Trademarks*